US008904982B2

(12) United States Patent
Lowe

(10) Patent No.: US 8,904,982 B2
(45) Date of Patent: Dec. 9, 2014

(54) HINGED ROCKER ARM AND VALVE OPENING ARRANGEMENT INCLUDING A HINGED ROCKER ARM

(75) Inventor: John Lowe, Bedford, PA (US)

(73) Assignee: Mack Trucks, Inc., Greensboro, NC (US)

( * ) Notice: Subject to any disclaimer, the term of this patent is extended or adjusted under 35 U.S.C. 154(b) by 1 day.

(21) Appl. No.: 13/883,775

(22) PCT Filed: Nov. 17, 2010

(86) PCT No.: PCT/US2010/056954

§ 371 (c)(1), (2), (4) Date: May 7, 2013

(87) PCT Pub. No.: WO2012/067610

PCT Pub. Date: May 24, 2012

(65) Prior Publication Data

US 2013/0220249 A1 Aug. 29, 2013

(51) Int. Cl.

| | |
|---|---|
| ***F01L 1/18*** | (2006.01) |
| ***F01L 1/26*** | (2006.01) |
| ***F01L 1/34*** | (2006.01) |
| *F01L 13/00* | (2006.01) |

(52) U.S. Cl.

CPC . *F01L 1/18* (2013.01); *F01L 1/181* (2013.01); *F01L 1/267* (2013.01); *F01L 1/34* (2013.01); *F01L 13/0005* (2013.01); *F01L 13/0015* (2013.01); *F01L 2001/186* (2013.01)

USPC ..... 123/90.39; 123/90.16

(58) Field of Classification Search

CPC ..... F01L 1/181; F01L 1/267; F01L 1/34; F01L 1/18; F01L 13/0005; F01L 2001/186; F01L 13/0015

USPC ..... 123/90.16, 90.39

See application file for complete search history.

(56) References Cited

U.S. PATENT DOCUMENTS

| | | | | |
|---|---|---|---|---|
| 2,024,401 | A | | 12/1935 | Swartzell |
| 4,690,110 | A | | 9/1987 | Nishimura et al. |
| 4,726,332 | A | * | 2/1988 | Nishimura et al. ..... 123/90.16 |
| 5,113,813 | A | | 5/1992 | Rosa |

(Continued)

FOREIGN PATENT DOCUMENTS

| | | | |
|---|---|---|---|
| EP | 1878883 | A1 | 1/2008 |
| EP | 2625395 | A1 | 8/2013 |

(Continued)

OTHER PUBLICATIONS

International Search Report (Jan. 20, 2011) for corresponding International App. PCT/US2010/056954.

(Continued)

*Primary Examiner* — Zelalem Eshete
(74) *Attorney, Agent, or Firm* — WRB-IP LLP

(57) ABSTRACT

A hinged rocker arm includes a first wing including a first opening for receiving a rocker shall and a first contacting surface, and a second wing including a second opening for receiving the rocker shaft, the second wing including a second contacting surface When the first and second wings are mounted on the rocker shaft, the first contacting surface and the second contacting surface are adapted to contact each other and thereby transfer a force in a direction transverse to an axis of the rocker shaft.

16 Claims, 3 Drawing Sheets

(56) References Cited

U.S. PATENT DOCUMENTS

| | | | | |
|---|---|---|---|---|
| 7,559,300 | B2 | 7/2009 | Ruggiero | |
| 2008/0223325 | A1 * | 9/2008 | Meistrick | 123/90.46 |
| 2009/0266317 | A1 | 10/2009 | Meacock | |
| 2010/0071643 | A1 | 3/2010 | Smith et al. | |
| 2010/0108007 | A1 | 5/2010 | Meistrick et al. | |
| 2010/0242878 | A1 | 9/2010 | Maekawa | |

FOREIGN PATENT DOCUMENTS

| | | | |
|---|---|---|---|
| FR | 2731043 | A1 | 8/1996 |
| JP | S60111010 | A | 6/1985 |
| JP | S61197706 | A | 9/1986 |
| JP | 2007146679 | A | 6/2007 |
| WO | 2008073122 | A1 | 6/2008 |
| WO | 2008073123 | A1 | 6/2008 |

OTHER PUBLICATIONS

Extended European Search Report for corresponding EP application No. 10859762.6 dated Apr. 14, 2014.

* cited by examiner

HINGED ROCKER ARM AND VALVE OPENING ARRANGEMENT INCLUDING A HINGED ROCKER ARM

BACKGROUND AND SUMMARY

The present invention relates generally to rocker arms.

US201010071643, which is incorporated by reference, discloses a valve opening arrangement including rocker arms for opening and closing valves. US2010/0071643 discloses that it can be desirable to provide a hydraulically movable piston for opening and closing a valve at a different timing than would occur using only a rocker arm and a cam. The inventor has using recognized that there is limited space available on the rocker arms, making it difficult to provide such a piston in many circumstances. It is desirable to address this problem.

According to a first aspect of the present invention, a hinged rocker arm comprises a first wing comprising a first opening for receiving a rocker shaft, and a first contacting surface, and a second wing comprising a second opening for receiving the rocker shaft, the second wing comprising a second contacting surface, wherein, when the first and second wings are mounted on the rocker shaft, the first contacting surface and the second contacting surface are adapted to contact each other and thereby transfer a force in a direction transverse to an axis of the rocker shaft.

According to another aspect of the present invention, a valve opening arrangement comprises a valve arrangement comprising a valve, the valve being movable against a force from a first valve position to a second valve position, a rocker shaft, and a hinged rocker arm comprising a first wing pivotably mounted on the rocker shaft and a first contacting surface, and a second wing pivotably mounted on the rocker shaft and comprising a second contacting surface, the first contacting surface and the second contacting surface being adapted to contact each other and thereby transfer a force in a direction transverse to an axis of the rocker shaft such that a third contacting surface on the hinged rocker arm contacts the valve arrangement and moves the valve against the force from the first valve position to the second valve position.

BRIEF DESCRIPTION OF THE DRAWINGS

The features and advantages of the present invention are well understood by reading the following detailed description in conjunction with the drawings in which like numerals indicate similar elements and in which.

DETAILED DESCRIPTION

Figure 1:
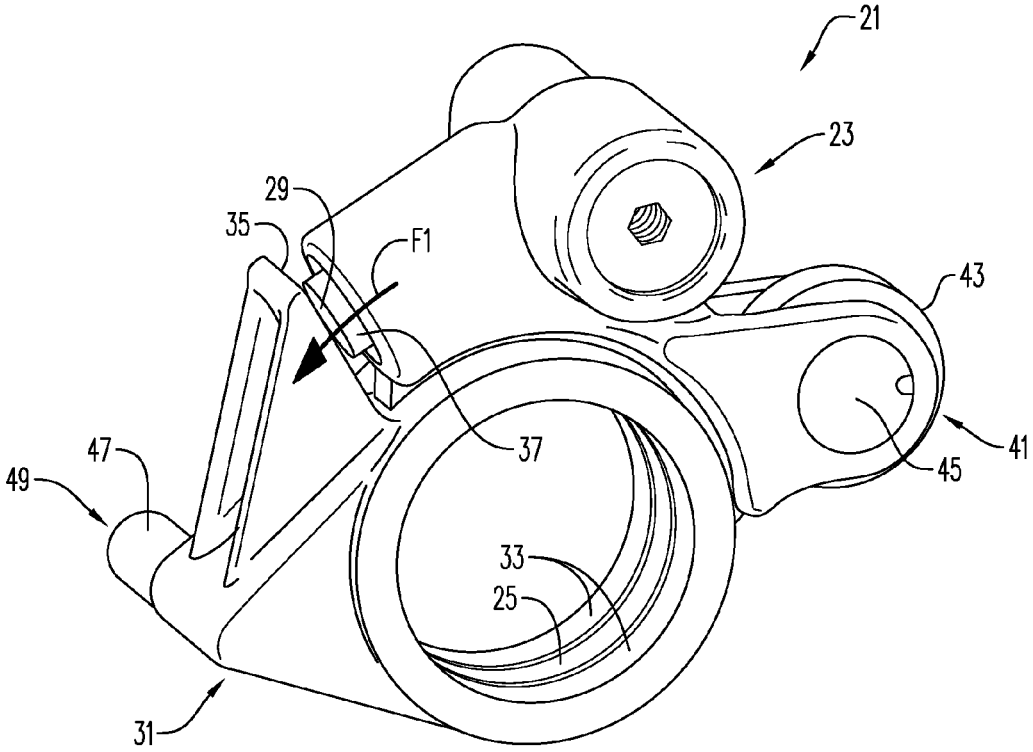
FIG. 1 is a perspective view of a hinged rocker arm according to an aspect of the present invention showing wings of the rocker arm pivoted to a contacting position.
Figure 2:
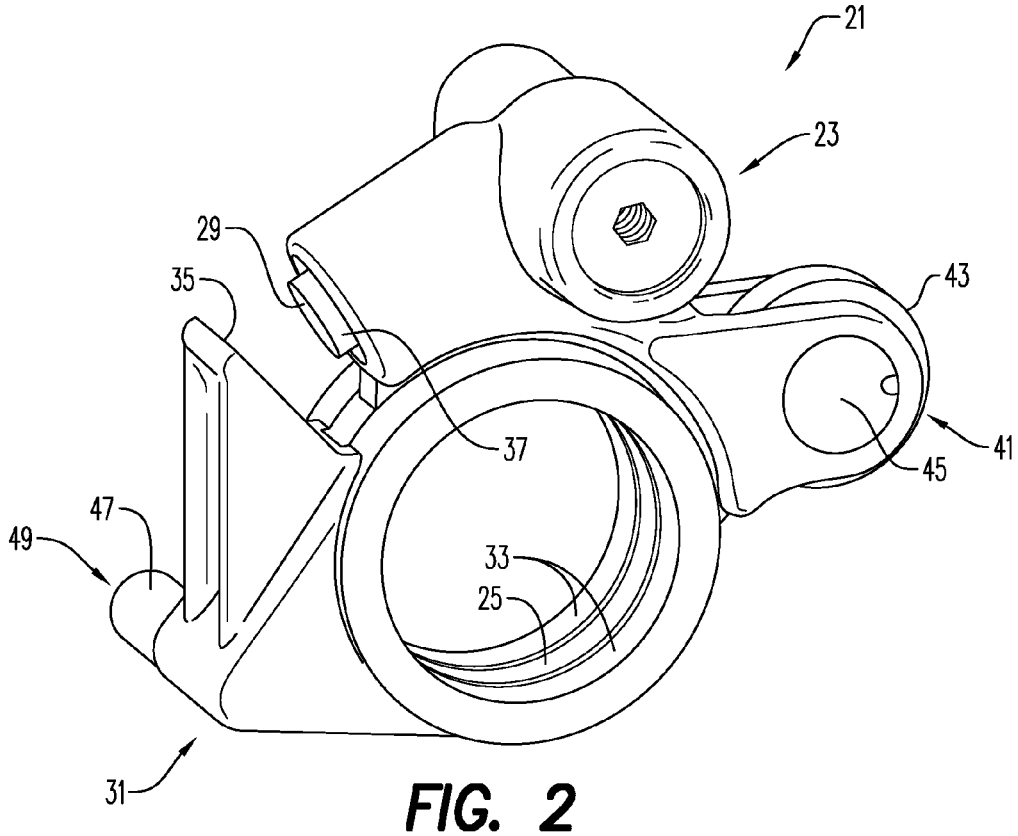
FIG. 2 is a perspective view of a hinged rocker arm according to an aspect of the present invention showing wings of the rocker am pivoted to a non-contacting position.
Figure 3:
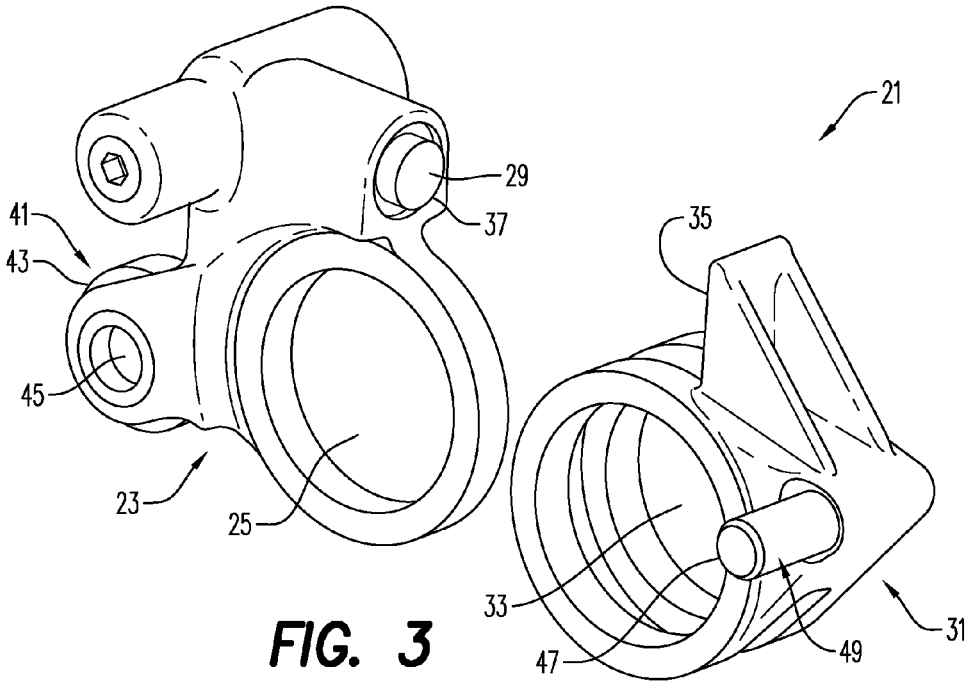
FIG. 3 is an exploded, perspective view of a hinged rocker arm according to an aspect of the present invention.

FIGS. 1-3 show a hinged rocker arm 21 according to an aspect of the present invention. The hinged rocker arm 21 comprises a first wing 23 comprising a first opening 25 for receiving a rocker shaft 27 (FIG. 4) and a first contacting surface 29. The hinged rocker arm 21 also comprises a second wing 31 comprising a second opening 33 for receiving the rocker shaft and a second contacting surface 35. When the first and second wings 23 and 31 are mounted on the rocker shaft, the first contacting surface 29 and the second contacting surface 35 are adapted to contact each other as seen in FIG. 1 and thereby transfer a force F1 in a direction transverse to an axis of the rocker shaft. Because the first and second wings 23 and 31 are pivotable relative to each other about the rocker shaft, the first and second contacting surfaces 29 and 35 can also be moved out of contact with each other by, inter alia, pivoting one or both of the first and second wings.

Figure 4:
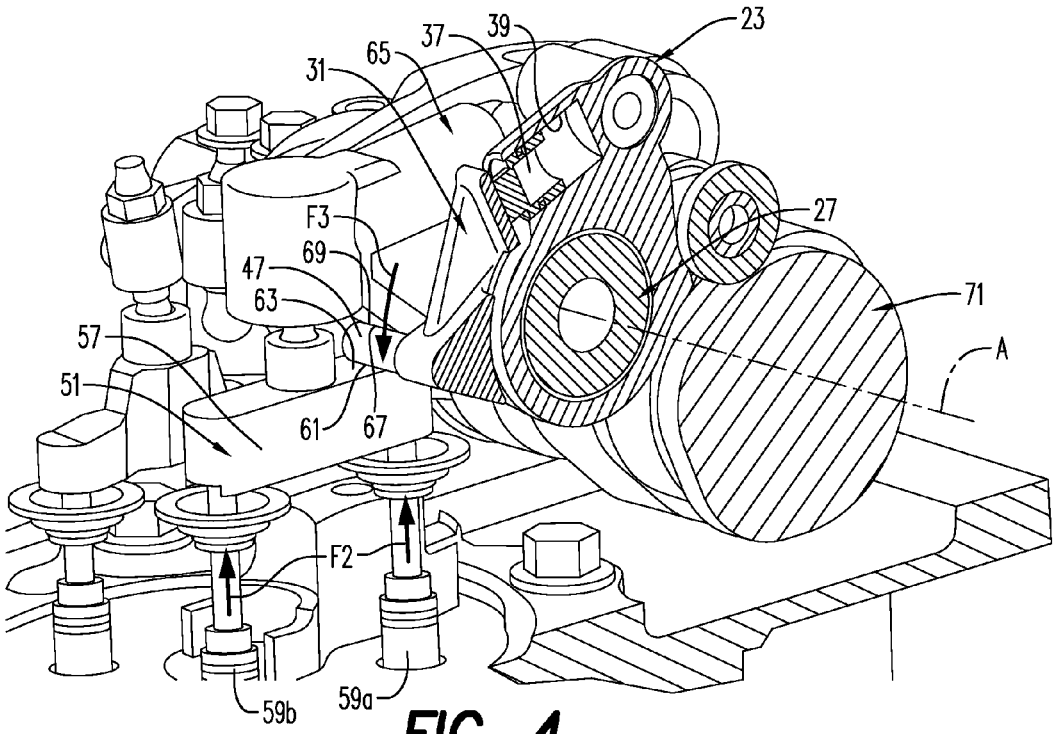
FIG. 4 is a perspective, partially cross-sectional view of a valve opening arrangement according to an aspect of the present invention.

At least one of the first contacting surface 29 and the second contacting surface 35 is a surface of a piston 37 movably disposed in a cylinder 39 on the hinged rocker arm 21. FIG. 4 shows the cylinder 39 and piston 37 provided on the first wing 23, however, the cylinder could be provided on the second wing 31 or a cylinder and piston could be provided on both the first and the second wing. The piston 37 will ordinarily be hydraulically driven, although it may be driven in other ways, such as pneumatically driven or driven electrically, such as by means of a solenoid. The piston 37 may be controlled by a check valve (not shown) so that, when the valve is open and a force is removed from the piston, the cylinder 39 will fill with hydraulic fluid, when the valve is open and a force is applied to the piston, the fluid will drain from the cylinder, and, when the valve is closed and the cylinder is full, the piston will be fixed in an outwardly extended position. As seen in, for example, FIGS. 1-3, the first wing 23 can comprise a cam follower 41, which may include a roller cam 43 rotatably mounted on an axle 45.

The second wing 31 comprises a third contacting surface 47 arranged so that a force applied to the third contacting surface causes the second wing to pivot independently from the first wing 23. The third contacting surface 47 can be in a variety of forms but is shown in FIGS. 1-5 as part of a rod 49 extending parallel to an axis of the second opening 33.

Figure 5:
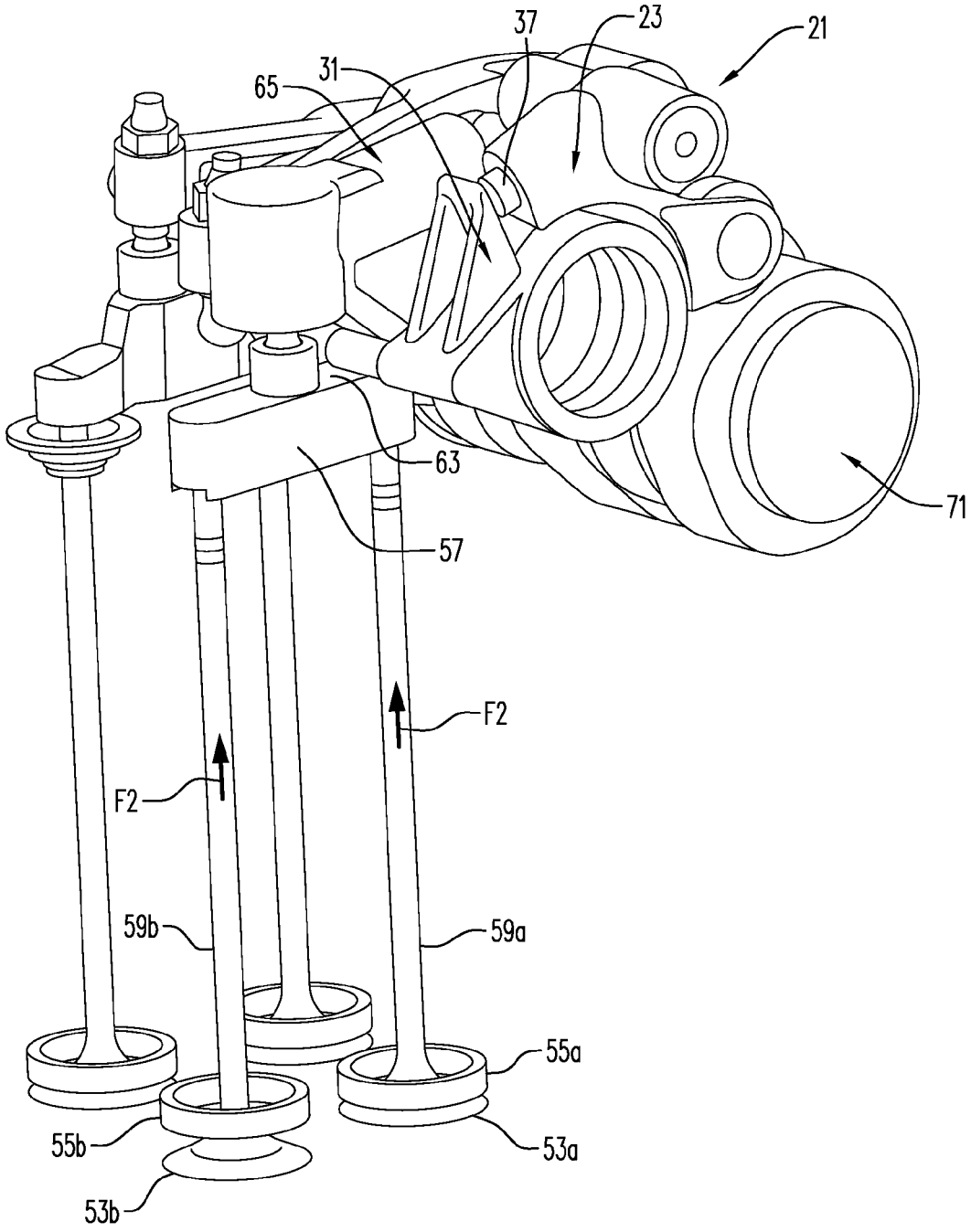
FIG. 5 is a perspective view of a valve opening arrangement according to an aspect of the present invention.

The hinged rocker arm 21 can be used in, for example, a valve opening arrangement 51 as shown in FIGS. 4 and 5. The valve opening arrangement 51 can comprise a valve 53*a* and 53*b* (FIG. 5) that is movable against a force F2, such as that from a spring (not shown), from a first valve position (such as a closed position relative to gaskets 55*a* and 55*b*) to a second valve position such as the open position relative to the gaskets, as seen in FIG. 5. The particular valve opening arrangement 51 shown in FIG. 5 comprises a yoke or bridge 57 connected to two valve stems 59*a* and 59*b* associated with two valves 53*a* and 53*b*, however, the valve opening arrangement can comprise one or more valves and associated components. Valve opening arrangements comprising plural valves connected to a bridge, including uses for such arrangements, are disclosed in US2009/0266317 and US2010/0071643, both of which are incorporated by reference.

The valve opening arrangement 51 comprises a rocker shaft 27. A hinged rocker arm 21 comprising a first wing 23 pivotably mounted on the rocker shaft 27 and comprising a first contacting surface 29, and a second wing 31 pivotably mounted on the rocker shaft and comprising a second contacting surface 35 is provided. The first contacting surface 29 and the second contacting surface 35 are adapted to contact each other and thereby transfer a force in a direction transverse to an axis A of the rocker shaft such that a valve arrangement contacting surface 61 on the hinged rocker arm 21 contacts a contacting surface 63 on the bridge 57 and moves the valve 53*a* and 53*b* against the force F from the first valve position to the second valve position.

A second rocker arm 65 can be pivotably mounted on the rocker shaft 27 and can comprise a fourth contacting surface 67. The second rocker arm 65 is pivotable between a first second rocker arm position and a second second rocker arm position and is arranged to contact the bridge 57, with the fourth contacting surface 67 contacting the contacting surface 63 on the bridge, to move the valve 53*a* and 53*b* against the force F2 from the first valve position to the second valve position when the second rocker arm pivots from the first second rocker arm position to the second second rocker arm position.

The second rocker arm 65 can comprise a fifth contacting surface 69. The fifth contacting surface 69 and the third contacting surface 47 on the hinged rocker arm 21 can be arranged so that when the second rocker arm pivots from the first second rocker arm position to the second second rocker arm position, the fifth contacting surface 69 and the third contacting surface 47 contact each other as seen in FIG. 4 so that a force F3 in a direction transverse to the axis of the rocker shaft 27 is transferred between the second rocker arm and the hinged rocker arm. Thus, when the second rocker arm 65 pivots from the first second rocker arm position to the second second rocker arm position, the portion of the hinged rocker arm to which the third contacting surface 47 is attached (in FIGS. 1-5, the second wing 31) pivots with the second rocker arm.

By the valve opening arrangement 51 shown in FIGS. 4 and 5, the valves 53*a* and 53*b* can both be moved against the force F2 by the second rocker arm 65 when it pivots from the first second rocker arm position to the second second rocker arm position and the fourth contacting surface 67 of the second rocker arm contacts the contacting surface 63 on the bridge 57. The fourth contacting surface 67 of the second rocker arm 65 can be arranged to contact the bridge 57 in such a manner that both of the valves 53*a* and 53*b* are moved against the forces F2, such as by contacting the bridge in a central part of the bridge. When the second rocker arm 65 pivots from the first second rocker arm position to the second second rocker arm position, its fifth contacting surface 69 can contact the third contacting surface 47 on the hinged rocker arm 21 so that the valve arrangement contacting surface 61 on the hinged rocker arm contacts the contacting surface 63 on the bridge 57 as well. However, it is not necessary that the contacting surface 61 contact the contacting surface 63 on the bridge 57 each time the second rocker arm 65 pivots to the second second rocker arm position.

When the piston 37 is retracted into the cylinder 39, when the second rocker arm 65 contacts the hinged rocker arm 21 to pivot the valve arrangement contacting surface 61 on the hinged rocker arm toward the contacting surface 63 on the bridge 57, the valve arrangement contacting surface 61 can be positioned to avoid contact with the contacting surface 63 on the bridge or to contact the contacting surface 63 without moving the contacting surface 63 beyond the position to which it is moved via contact with the fourth contacting surface 67 of the second rocker arm 65. However, when the piston 37 is extended from the cylinder 39, the force F1 (FIG. 1) moves the second wing 33 and the valve arrangement contacting surface 61 beyond the point to which it is moved by the second rocker arm 65 alone, which can move the valves or, depending upon the position at which the valve arrangement contacting surface 61 contacts the contacting surface 63 of the bridge 57, one of the valves. In the valve opening arrangement 51 shown in FIG. 5, the valve arrangement contacting surface 61 contacts the contacting surface 63 of the bridge 57 inboard of the point at which the fourth contacting surface 67 contacts the contacting surface 63 of the bridge. Consequently, when the piston 37 is extended from the cylinder 39, the valve arrangement contacting surface 61 of the hinged rocker arm 21 can contact the contacting surface 63 of the bridge a manner so that only valve 53*a* is affected by the extension of the piston.

It will further be appreciated that the cams on the camshaft 71 (FIGS. 4 and 5) that contacts the cam follower 41 on the hinged rocker arm 21 and a cam follower (not shown) on the second rocker arm 65 can be arranged to cause the hinged rocker arm to pivot independently of the second rocker arm. Thus, contact between the valve arrangement contacting surface 61 on the hinged rocker arm 21 and the contacting surface 63 on the bridge 57 can occur when there is no contact between the fourth contacting surface 67 of the second rocker arm and the contacting surface 63 on the bridge.

In the present application, the use of terms such as "including" is open-ended and is intended to have the same meaning as terms such as "comprising" and not preclude the presence of other structure, material, or acts. Similarly, though the use of terms such as "can" or "may" is intended to be open-ended and to reflect that structure, material, or acts are not necessary, the failure to use such terms is not intended to reflect that structure, material, or acts are essential. To the extent that structure, material, or acts are presently considered to be essential, they are identified as such.

While this invention has been illustrated and described in accordance with a preferred embodiment, it is recognized that variations and changes may be made therein without departing from the invention as set forth in the claims.

What is claimed is:

1. A hinged rocker arm, comprising:

a rocker shaft;

a first wing comprising a circular first opening for receiving the rocker shaft, and a first contacting surface; and a second wing comprising a circular second opening for receiving the rocker shaft, the second wing comprising a second contacting surface, wherein the first and second wings are both pivotably mounted on the rocker shaft and, when the first and second wings are mounted on the rocker shaft, the first opening and the second opening are coaxial, and the first contacting surface and the second contacting surface are adapted to contact each other and thereby transfer a force in a direction transverse to an axis of the rocker shaft, wherein the hinged rocker arm comprises a single cam follower, the cam follower being disposed on the first wing.

2. The hinged rocker arm as set forth in claim 1, wherein at least one of the first contacting surface and the second contacting surface is a surface of a piston movably disposed in a cylinder on the binged rocker arm.

3. The hinged rocker arm as set forth in claim 2, wherein the first contacting surface is the surface of the piston and the cylinder is provided in the first wing.

4. The hinged rocker arm as set forth in claim 2, wherein the piston is hydraulically driven.

5. The hinged rocker arm as set forth in claim 1, wherein the second wing comprises a third contacting surface arranged so that a force applied to the third contacting surface causes the second wing to pivot independently from the first wing.

6. The hinged rocker arm as set forth in claim 5, wherein the third contacting surface is part of a rod extending parallel to an axis of the second opening.

7. The hinged rocker arm as set forth in claim 1, wherein the cam follower comprises a roller cam.

8. A valve opening arrangement, comprising:

a valve arrangement comprising a valve, the valve being movable against a force from a first valve position to a second valve position;

a rocker shaft; and a hinged rocker arm comprising a first wing, the first wing comprising a circular first opening for receiving the rocker shaft so that the first wing is pivotably mounted on the rocker shaft, and a first contacting surface, and a second wing, the second wing comprising a circular second opening for receiving the rocker shaft so that the second wing pivotably mounted on the rocker shaft, and a second contacting surface, wherein the first opening and the second opening are coaxial when the first and second wings are mounted on the rocker shaft, the first contacting surface and the second contacting surface being adapted to contact each other and thereby transfer a force in a direction transverse to an axis of the rocker shaft such that a third contacting surface on the hinged rocker min contacts the valve arrangement and moves the valve against the force from the first valve position to the second valve position, wherein the hinged rocker arm comprises a single cam follower, the cam follower being disposed on the first wing.

9. The valve opening arrangement as set forth in claim 8, comprising a second rocker arm pivotably mounted on the rocker shaft and comprising a fourth contacting surface, the second rocker arm being pivotable between a first second rocker arm position and a second second rocker arm position and being arranged to contact the valve arrangement via the fourth contacting surface to move the valve against the force from the first valve position to the second valve position when the second rocker arm pivots from the first second rocker arm position to the second second rocker arm position.

10. The valve opening arrangement as set forth in claim 9, wherein the second rocker arm comprises a fifth contacting surface and the hinged rocker arm comprises a sixth contacting surface, the fifth contacting surface and the sixth contacting surface being arranged so that, when the second rocker arm pivots from the first second rocker arm position to the second second rocker arm position, the fifth contacting surface and the sixth contacting surface contact each other so that a second force in a direction transverse to the axis of the rocker shaft is transferred between the second rocker arm and the hinged rocker arm.

11. The valve opening arrangement as set forth in claim 10, wherein at least one of the first contacting surface and the second contacting surface is a surface of a piston movably disposed in a cylinder on the hinged rocker arm.

12. The valve opening arrangement as set forth in claim 11, wherein the first contacting surface is the surface the piston and the cylinder is provided in the first wing.

13. The valve opening arrangement as set forth in claim 11, wherein the piston is hydraulically driven.

14. The valve opening arrangement as set forth in claim 8, wherein the second wing comprises a third contacting surface arranged so that a force applied to the third contacting surface causes the second wing to pivot independently from the first wing.

15. The valve opening arrangement as set forth in claim 14, wherein the third contacting surface is part of a rod extending parallel to an axis of the second opening.

16. The valve opening arrangement as set forth in claim 8, wherein the cam follower comprises a roller cam.

* * * * *